US009624717B2

(12) United States Patent
Chan et al.

(10) Patent No.: US 9,624,717 B2
(45) Date of Patent: Apr. 18, 2017

(54) DOOR WITH EMBEDDED PROTECTING DEVICE

(71) Applicant: Tak Lai Vic Chan, Tseung Kwan O (HK)

(72) Inventors: Tak Lai Vic Chan, Tseung Kwan O (HK); Tat Hon Wong, Tseung Kwan O (HK)

(73) Assignee: Tak Lai Vic Chan, Hong Kong (CN)

( * ) Notice: Subject to any disclaimer, the term of this patent is extended or adjusted under 35 U.S.C. 154(b) by 0 days.

(21) Appl. No.: 14/927,149

(22) Filed: Oct. 29, 2015

(65) Prior Publication Data

US 2016/0123058 A1 May 5, 2016

(30) Foreign Application Priority Data

Nov. 3, 2014 (CN) ..... 2014 2 0654068 U

(51) Int. Cl.

| | |
|---|---|
| ***E06B 7/36*** | (2006.01) |
| ***E05D 11/00*** | (2006.01) |
| ***E05D 11/06*** | (2006.01) |
| ***E06B 3/70*** | (2006.01) |
| ***E06B 3/72*** | (2006.01) |

(52) U.S. Cl.

CPC ..... *E06B 7/367* (2013.01); *E05D 11/0054* (2013.01); *E05D 11/06* (2013.01); *E06B 3/7015* (2013.01); *E06B 3/725* (2013.01); *E05D 2011/0072* (2013.01); *E05Y 2900/132* (2013.01)

(58) Field of Classification Search

CPC . E06B 7/367; E06B 7/362; E06B 7/36; E06B 3/486; Y10T 16/533

USPC ..... 49/383

See application file for complete search history.

(56) References Cited

U.S. PATENT DOCUMENTS 1,101,960 A * 6/1914 Roberti ..... E06B 7/367 49/383

2,557,716 A * 6/1951 Allee ..... E05D 5/06 16/250

(Continued)

*Primary Examiner* — Justin Rephann

(74) *Attorney, Agent, or Firm* — Muncy, Geissler, Olds & Lowe, P.C.

(57) ABSTRACT

The invention belongs to the technical field of closing devices, and particularly relates to a door with an embedded protecting device. The invention aims at providing a door enabling the service life of the door and the protecting device to be prolonged. To solve the above problem, according to the technical scheme, the door with the embedded protecting device comprises a door sheet and a door frame, wherein the door sheet is connected with the door frame through hinges. The door further comprises an elastic sheet and/or an elastic column, and one end of the elastic sheet and/or the elastic column is fixedly connected with the inner side of a vertical frame. A first clamped board and a second clamped board are also arranged inside the door sheet, and the first clamped board and the second clamped board are fixedly connected with the inner side of the door frame to form a hollow area which matches with the elastic sheet and/or the elastic column. The hollow area further includes an opening and a bottom which are positioned on different sides inside the door sheet, and the elastic sheet and/or the elastic column extend/extends into the hollow area from the opening.

8 Claims, 4 Drawing Sheets

(56) References Cited

U.S. PATENT DOCUMENTS 2,960,733 A * 11/1960 Nida ..... E06B 3/08 49/383
2,995,785 A * 8/1961 Hallenbeck ..... E06B 7/367 16/250
4,261,140 A * 4/1981 McLean ..... E05F 5/04 16/83
4,290,233 A * 9/1981 Hubbard ..... E06B 7/362 49/383
4,893,666 A * 1/1990 Hormann ..... E06B 3/485 160/201
5,359,812 A * 11/1994 Mayfield ..... E06B 7/367 49/383
5,778,601 A * 7/1998 Wu ..... E06B 7/367 49/383
6,029,409 A * 2/2000 Wilson ..... E04G 21/30 150/154
6,141,909 A * 11/2000 Hanson ..... E06B 7/367 16/250
6,298,605 B1 * 10/2001 Delefosse ..... E06B 7/367 49/381
6,308,474 B1 * 10/2001 Wilson ..... E04G 21/30 150/154
6,497,073 B2 * 12/2002 Webb ..... E06B 7/367 16/250
7,712,257 B2 * 5/2010 Johnson ..... E06B 7/367 49/383
8,104,143 B2 * 1/2012 Heger ..... E05D 11/0054 16/223
2003/0205001 A1 * 11/2003 Williams ..... E05D 11/0054 49/383
2006/0101617 A1 * 5/2006 Webb ..... E06B 7/367 16/250
2010/0162630 A1 * 7/2010 Shim ..... E06B 7/367 49/383
2010/0257788 A1 * 10/2010 McRoskey ..... E06B 7/367 49/383
2011/0094057 A1 * 4/2011 Duffy ..... E05D 3/02 16/249

* cited by examiner

DOOR WITH EMBEDDED PROTECTING DEVICE

TECHNICAL FIELD

The invention belongs to a fixed or movable closing device used at the position of an opening of a building, a vehicle, a fence or a similar surround, and in particular relates to a door with an embedded protecting device.

BACKGROUND

Typically, when a door is opened, it rotates around door hinges under the action of its own gravity and external force to close automatically, which causes inconvenience to people's life. To solve the problem, a protecting device is designed to facilitate fixing the door at a specific position when it is opened.

However, the structure of the door can be affected and the service life of the door can be shortened due to the defect of unbalanced stress caused when the existing protecting device is externally mounted and positioned on the top of the door sheet. Besides, the protecting device has poor durability due to structural particularity.

SUMMARY OF THE INVENTION

The invention aims at providing a door with an embedded protecting device so as to prolong the service life of the door and the protecting device.

To solve the above problem, according to the technical scheme:

a door with an embedded protecting device comprises a door sheet and a door frame, wherein the door sheet is connected with the door frame through hinges. The door further comprises an elastic sheet and/or an elastic column, and one end of the elastic sheet and/or the elastic column is fixedly connected with the inner side of a vertical frame. A first clamped board and a second clamped board are also arranged inside the door sheet, and the first clamped board and the second clamped board are fixedly connected with the inner side of the door frame to form a hollow area which matches with the elastic sheet and/or the elastic column. The hollow area further includes an opening and a bottom which are positioned on different sides inside the door sheet, and the elastic sheet and/or the elastic column extend/extends into the hollow area from the opening.

Preferably, the door further comprises a bearing, wherein the inner ring of the bearing is fixed on the first clamped board through a fixing device which comprises a bolt.

Preferably, the distance from the bearing to the opening is 0-25 cm.

Preferably, at least one bearing is provided.

Preferably, one bearing is provided, and the difference between the distance from the bearing to the top of the first clamped board and the distance from the bearing to the bottom of the first clamped board is 0-8 cm.

Preferably, the door comprises a first bearing and a second bearing, wherein the first bearing is positioned on the top of the first clamped board, and the second bearing is positioned under the first bearing.

Preferably, the first clamped board and/or the second clamped board form/forms cavities/a cavity with the door panel.

Preferably, the cavities/cavity are/is filled with fillers.

Preferably, two opposite sides of the first clamped board and the second clamped board are smooth surfaces.

The invention has the following technical effects: 1. the elastic sheet and/or the elastic column can be used for filing gaps between the door sheet and the door frame so that accidental injury caused when fingers are pinched by the gaps can be avoided, especially, the door achieves good effects in the aspect of preventing children or seniors unable to get about from being pinched; further, the door can be normally used while avoiding pinching so that the technical effect is obvious; 2. the protecting device is embedded in the door so that unbalanced force of the protecting device and the door can be eliminated and the service life of the protecting device and the door can be prolonged; 3. the protecting device is embedded in the door and therefore gaps which may be produced when an outer door gap protecting device is installed can be avoided; 4. the hollow area defined by the first clamped board and the second clamped board can be used for guiding, thus reducing friction and facilitating door opening; and 5. the bearings are added on the clamped boards, so that friction is reduced, the elastic sheet and/or the elastic column can be easily inserted into the door, abrasion is avoided and the door is easy to use.

BRIEF DESCRIPTION OF THE DRAWINGS

To describe the content of the invention more clearly and completely, accompanying drawings that can describe the conception of the invention most suitably are provided as below. It is understood that the provided drawings aim to describe the conception of the invention, rather than all the design scheme of the invention, and are not to be considered as the limit to the content of the invention. Any scheme given without departing from the spirit of the provided drawings is under the protection scope of the invention.

DETAILED DESCRIPTION

Figure 1:
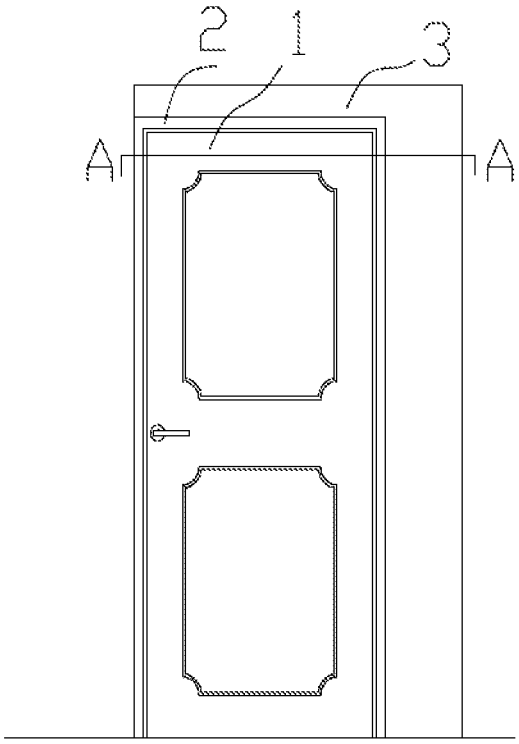
FIG. 1 is a structure diagram of the door, the door frame and the wall.
Figure 2:
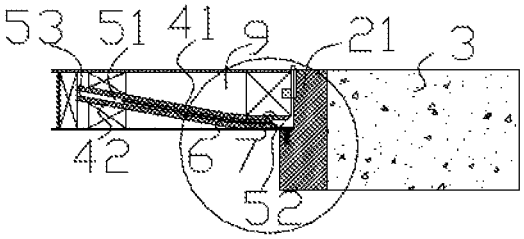
FIG. 2 is an A-A section view of the door frame.
Figure 3:
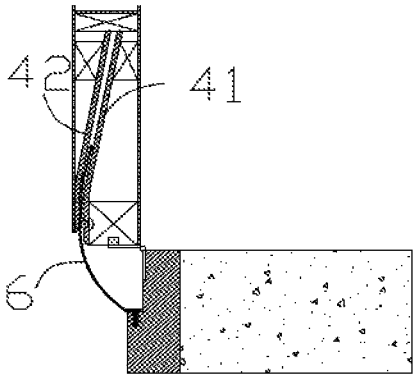
FIG. 3 is an A-A section view after the door is opened.
Figure 4:
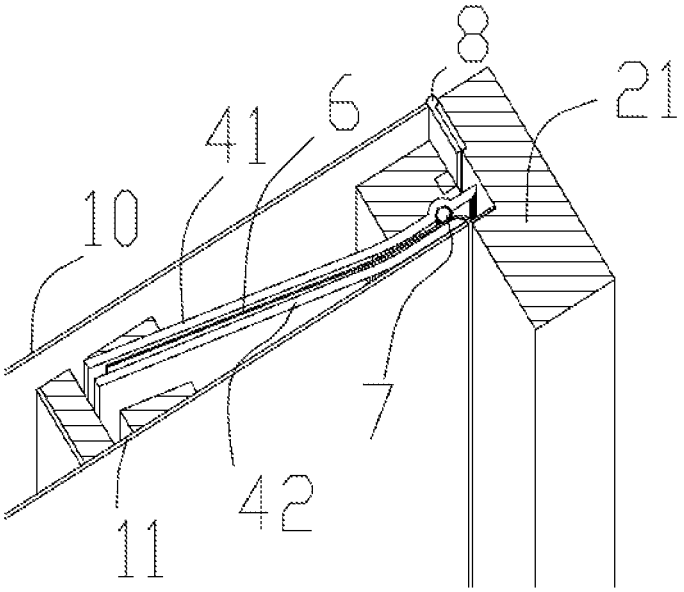
FIG. 4 is a three-dimensional structure diagram of the door and the door frame.

To describe the content of the invention more clearly and completely, accompanying drawings that can describe the conception of the invention most suitably are provided as below. It is understood that the provided drawings aim to describe the conception of the invention, rather than the design scheme of the invention, and are not to be considered as the limit to the content of the invention.

Any scheme given without departing from the spirit of the provided drawings is under the protection scope of the invention.

Embodiment 1

Referring to FIG. 1, FIG. 2, FIG. 3, FIG. 4 and FIG. 7, the door with the embedded protecting device comprises the door sheet 1 and the door frame 2, and the door sheet 1 is connected with the door frame 2 through the hinges 8. The door further comprises the elastic sheet 6, wherein the elastic sheet 6 can be replaced by the elastic column, or the door comprises both the elastic sheet 6 and the elastic column, i.e. two or more of them are included, and one end of the elastic sheet and/or one end of the elastic column is fixedly connected with the inner side of the vertical frame 21. The door sheet comprises the first clamped board 41 and the second clamped board 42, wherein the first clamped board and the second clamped board are fixedly connected with the inner side of the door frame to form the hollow area 51 which matches with the elastic sheet 6 and/or the elastic column and includes the opening 52 and the bottom 53. The opening and the bottom are positioned on different sides inside the door sheet, i.e. the hollow area has certain degree of curvature: supposing the four angular vertexes of the cross section of the door are set as A, B, C and D, the vertex close to the elastic sheet is A and the other three vertexes are sequentially B, C and D in clockwise direction, thus the fact that the opening and the bottom of the hollow area are positioned on different sides inside the door sheet means that the bottom 53 of the door sheet is positioned at the position of D or infinitely extends to D, and the elastic sheet and/or the elastic column extend/extends into the hollow area from the opening. When used, the door frame 2 is fixed on the wall 3.

To reduce the friction between the elastic sheet and the clamped boards, the door further comprises the bearing 7, and the inner ring of the bearing is fixed on the first clamped board through the fixing device which comprises the bolt. The inner ring of the bearing can also be fixed on the column, and then one end of the column is fixed on the first clamped board.

In order to enable the bearing to decrease friction better, the distance from the bearing to the opening is 0-25 cm.

Figure 6:
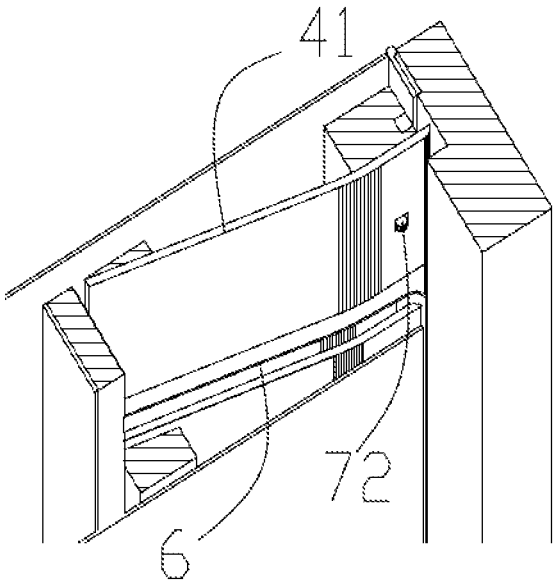
FIG. 6 is a section view of the door with one bearing.
Figure 7:
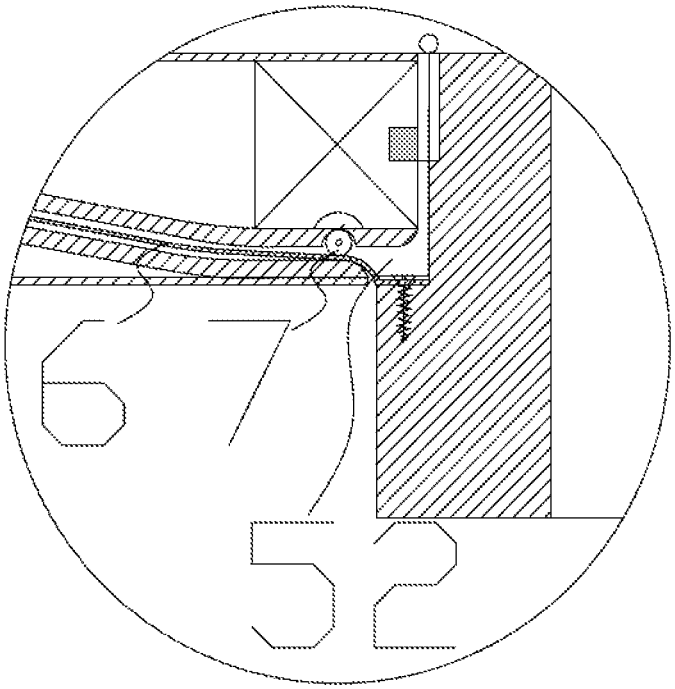
FIG. 7 is a partial enlarged view of the A-A section view.

At least one bearing is provided. When the door comprises one bearing, according to FIG. 6, the bearing 72 is positioned in the middle of the first clamped board, certainly, the bearing can be arranged right in the middle or in an area near the middle of the first clamped board. When the difference between the distance from the bearing to the top of the first clamped board and that from the bearing to the bottom of the clamped board I is 0-8 cm, friction can be effectively decreased.

Figure 5:
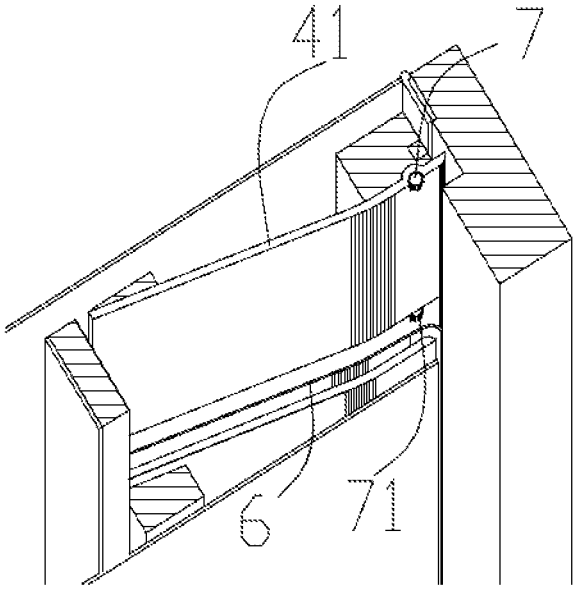
FIG. 5 is a section view of the door with two bearings.

As shown in FIG. 5, when two or more bearings are provided, i.e. the door comprises the first bearing 7 and the second bearing 71, the first bearing is positioned on the top of the first clamped board, the second bearing 71 is arranged under the first bearing, and the second bearing 71 can be positioned either at the bottom or in the middle of the elastic sheet 6 and/or the elastic column.

To reduce the weight of the door sheet, the cavities/cavity 9 are/is formed between the first clamped board and/or the second clamped board and the door panel.

In order to decrease noise generated when the door is opened or closed, the cavities/cavity are/is filled with the fillers.

In order to reduce the friction between the elastic sheet 6 and the clamped boards to facilitate use, the two opposite sides of the first clamped board and the second clamped board are smooth surfaces.

The invention claimed is:

1. A door with an embedded protecting device, comprising:

a door sheet;

a door frame, the door sheet being connected with the door frame through hinges, an elastic member one end of which is fixedly connected with an inner side of the door frame;

a first clamped board and a second clamped board being arranged inside the door sheet, and the first clamped board and the second clamped board being fixedly connected with an inner side of the door sheet to form a hollow area which receives the elastic member;

a bearing, and an inner ring of the bearing is fixed on the first clamped board through a fixing device which comprises a bolt; and the hollow area further including an opening and a bottom which are positioned on different sides inside the door sheet, and the elastic member extending into the hollow area from the opening.

2. The door according to claim 1, wherein the distance from the bearing to the opening is between 0 and 25cm.

3. The door according to claim 2, wherein a difference between a distance from the bearing to a top of the first clamped board and a distance from a bearing to a bottom of the first clamped board is 0-8cm.

4. The door according to claim 1, wherein the elastic member is an elastic sheet.

5. The door according to claim 1, wherein the elastic member is an elastic column.

6. A door with an embedded protecting device, comprising:

a door sheet;

a door frame, the door sheet being connected with the door frame through hinges, an elastic member one end of which is fixedly connected with an inner side of the door frame;

a first clamped board and a second clamped board being arranged inside the door sheet, and the first clamped board and the second clamped board being fixedly connected with an inner side of the door sheet to form a hollow area which receives the elastic member;

the hollow area further including an opening and a bottom which are positioned on different sides inside the door sheet, and the elastic member extending into the hollow area from the opening; and a first bearing and a second bearing, wherein the first bearing is positioned on a top of the first clamped board and the second bearing is positioned under the first bearing.

7. The door according to claim 6, wherein at least one of the first clamped board and the second clamped board forms at least one cavity with a door panel.

8. The door according to claim 7, the at least one cavity is filled with fillers.

* * * * *